US006281856B1

(12) United States Patent
Tang et al.

(10) Patent No.: US 6,281,856 B1
(45) Date of Patent: Aug. 28, 2001

(54) METHOD FOR MAKING ANTENNA OF COAXIAL CABLE AND THE ANTENNA SO MADE

(75) Inventors: Chiu-Yu Tang, Montery Park, CA (US); Johnny Yang, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/454,672

(22) Filed: Dec. 3, 1999

(51) Int. Cl.[7] ..... H01Q 9/04
(52) U.S. Cl. ..... 343/790; 343/791
(58) Field of Search ..... 343/791, 792, 343/790, 820, 5 PD, 806, 856, 715, 749; 333/237, 12, 243

(56) References Cited

U.S. PATENT DOCUMENTS

| | | | | |
|---|---|---|---|---|
| 4,180,819 | * | 12/1979 | Nakano | 343/792 |
| 4,358,764 | * | 11/1982 | Cheal et al. | 343/5 PD |
| 4,400,702 | * | 8/1983 | Tanaka | 343/790 |
| 4,599,121 | * | 7/1986 | Edwards et al. | 156/48 |
| 4,641,110 | * | 2/1987 | Smith | 333/12 |
| 4,660,007 | * | 4/1987 | Edwards et al. | 333/237 |
| 4,748,450 | * | 5/1988 | Hines et al. | 343/820 |

* cited by examiner

*Primary Examiner*—Don Wong
*Assistant Examiner*—Chuc D Tran
(74) *Attorney, Agent, or Firm*—Wei Te Chung

(57) ABSTRACT

A cable antenna includes a circuit board to which first ends of two antenna cables and a coupling cable are soldered. A second end of the coupling cable forms a connector for connection with a signal receiving/transmitting circuit. Each of the antenna cables has a second free end exposed to the atmosphere for receiving/transmitting electromagnetic signals. An outer jacket of each antenna cable is removed along a first predetermined length measured from the free end thereof to expose a braided shield. A second predetermined length of the braided shield measured from the free end is removed for exposing an inner dielectric layer that surrounds a core conductor. The second length is less than the first length thereby leaving a portion of the exposed braided shield on the inner dielectric layer. The braided shield that is cut from the cable is twisted to form an elongate consolidated conductor. The consolidated conductor made of the braided shield is then soldered to the portion of the exposed braided shield that is left on the inner dielectric layer thereby completing the cable antenna. Preferably, the consolidated conductor made of the braided shield is arranged to be substantially normal to a central axis of the cable. If desired, the core conductor may be bent 90 degrees off the central axis of the cable. The consolidated conductor made of the braided shield may be replaced by other conductive member having substantially the same length.

18 Claims, 3 Drawing Sheets

METHOD FOR MAKING ANTENNA OF COAXIAL CABLE AND THE ANTENNA SO MADE

BACKGROUND OF THE INVENTION

1. Field of the Invention

The present invention generally relates to an antenna made of coaxial cables, and in particular to a simplified method for making the coaxial cable antenna and the antenna so made.

2. The Prior Art

Wireless connection between information appliances, such as notebook computers, and network systems is becoming a modem trend for information appliances. An antenna is required for facilitating wireless connection. Since the information appliances usually have a small size, a conventional antenna occupying a great amount of space is not suitable for such an application. Thus an antenna made of coaxial cables that are widely used in information appliances is prevailing. An coaxial cable antenna may comprise at least one coaxial cable having a first end connected to a signal processing circuit of an information appliance and a second end exposed for receiving/transmitting electromagnetic signals.

A coaxial cable usually comprises a core conductor surrounded by an inner dielectric layer, a braided shield surrounding the inner dielectric layer and an insulative jacket surrounding the braided shield. To serve as an antenna, two conductors carrying data signal and grounding signal are required. The braided shield and the core conductor of a coaxial cable must be separated along a predetermined length at the exposed second end thereof. A conventional way to form the antenna is to remove a predetermined length of the jacket and manually detaching strands that make the braided shield from the inner dielectric layer and separating the strands from each other. The strands are bent in a transverse direction and then twisted together to form a grounding signal conductor, while the core conductor serves as a data signal conductor. Manually separating the strands one by one is a time-consuming and laborious job hindering mass production of the cable antennas.

SUMMARY OF THE INVENTION

Thus, an object of the present invention is to provide an efficient and simplified method for making cable antennae.

Another object of the present invention is to provide a method for mass-producing cable antennae.

A further object of the present invention is to provide a cable antenna so made.

To make a cable antenna in accordance with the present invention, a circuit board is provided with two antenna cables and a coupling cable soldered thereto. Each of the antenna cables has a remote free end wherein an outer jacket is removed along a predetermined first length measured from the free end to expose a braided shield. A predetermined second length of the braided shield measured from the free end is removed for exposing an inner dielectric layer that surrounds a core conductor. The second length is less than the first length thereby leaving a portion of the exposed braided shield on the inner dielectric layer. The braided shield that is cut from the cable is twisted to form an elongate consolidated conductor. The consolidated conductor made of the braided shield is then soldered to the portion of the exposed braided shield that is left on the inner dielectric layer thereby completing the cable antenna.

Preferably, the consolidated conductor made of the braided shield is arranged to be substantially normal to a central axis of the cable. If desired, the core conductor may be bent 90 degrees off the central axis of the cable. The consolidated conductor made of the braided shield may be replaced by other conductive member having substantially the same length.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1:
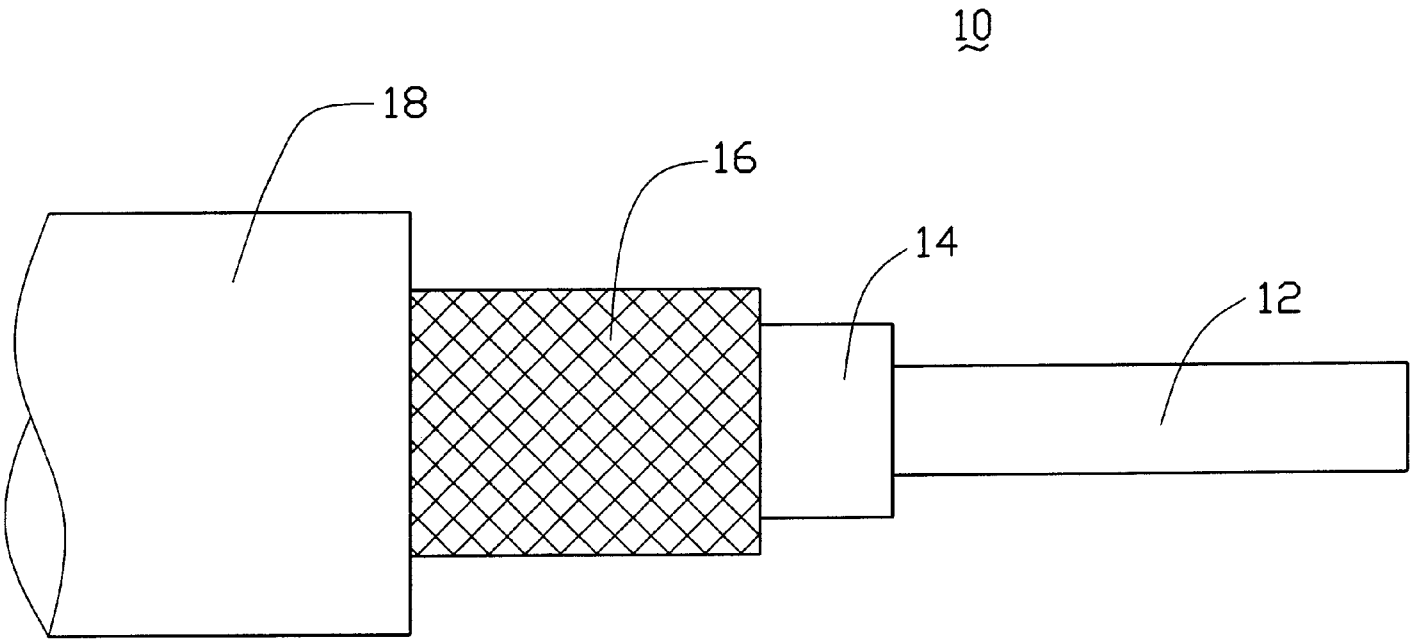
FIG. 1 (PRIOR ART)
FIG. 1 is a perspective view showing the structure of a conventional coaxial cable.

Before a detailed description of the present invention is given, a brief discussion of a conventional coaxial cable is given first. Referring to FIG. 1, a conventional coaxial cable 10 comprises a core conductor 12 having a central axis surrounded by an inner dielectric layer 14, a braided shield 16 surrounding the inner dielectric layer 14 and an outer insulative jacket 18 enclosing the braided shield 16. The braided shield 16 is made by braiding conductive filaments, such as thin metal wires, in a predetermined pattern.

Figure 3:
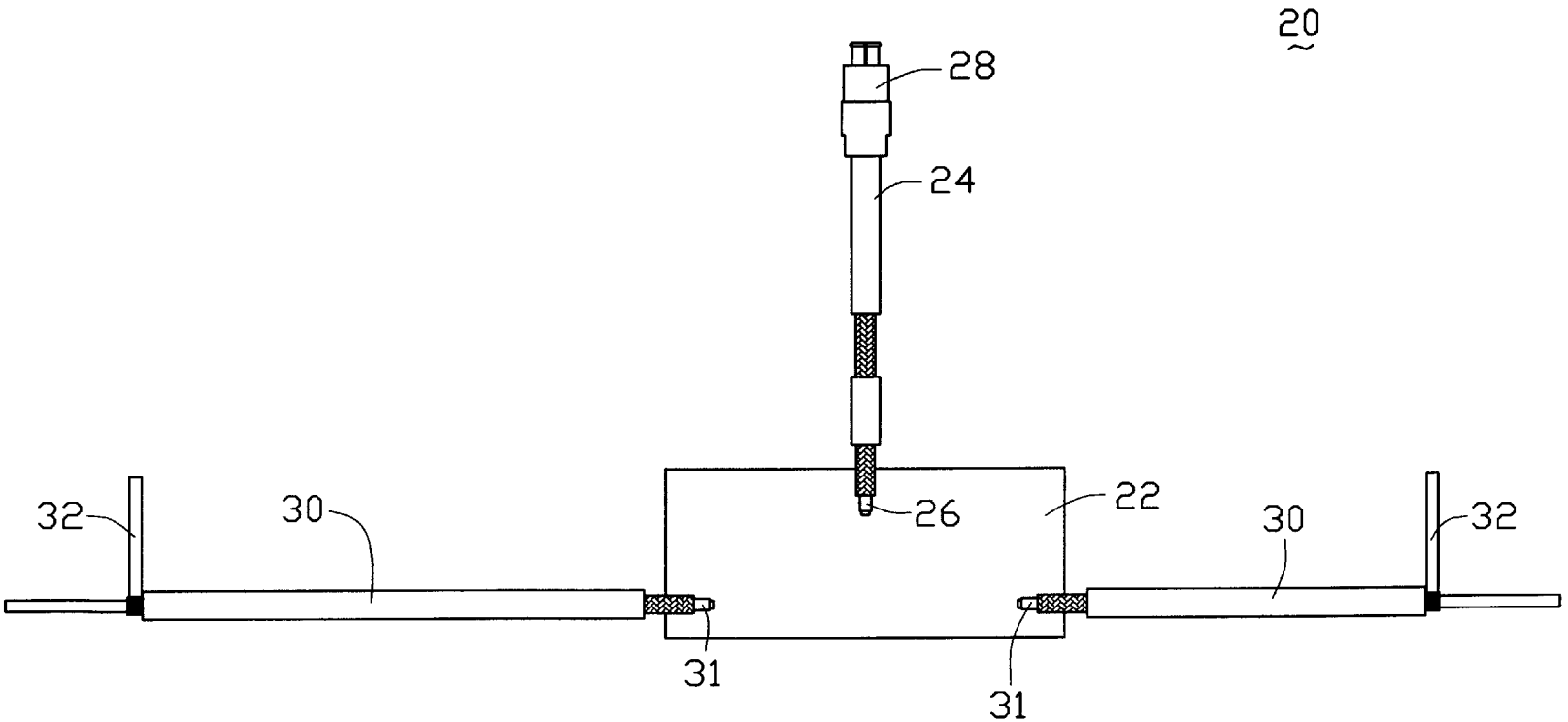
FIG. 3 is a plan view of the cable antenna in accordance with the present invention.

Referring to FIG. 3, a cable antenna 20 comprises a circuit board 22 carrying conductive traces, as well as electronic elements if needed, thereon, a coupling cable 24 having a first end 26 soldered to the circuit board 22 and a second end forming a connector 28 for connection with for example a signal processing circuit of an information appliance (not shown), two antenna cables 30 having first ends 31 soldered to the circuit board 22 and opposite second ends (not labeled) extending therefrom in opposite directions for receiving/transmitting electromagnetic signals. Both the coupling cable 24 and the antenna cables 30 are made of coaxial cables as shown in FIG. 1. However, coaxial cables of other types may also be used. If desired, the coupling cable 24 may be replaced by an suitable connection means.

Figure 2A:
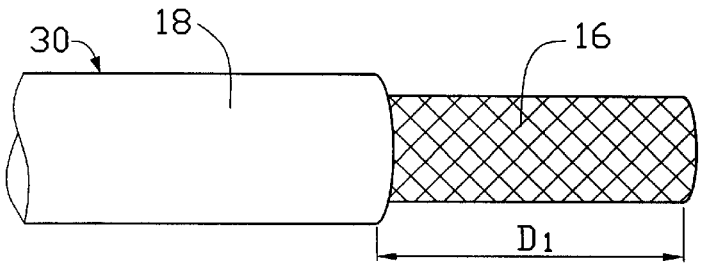
FIGS. 2A–2D sequentially shows steps of forming an antenna cable of a cable antenna in accordance with the present invention.
Figure 2B:
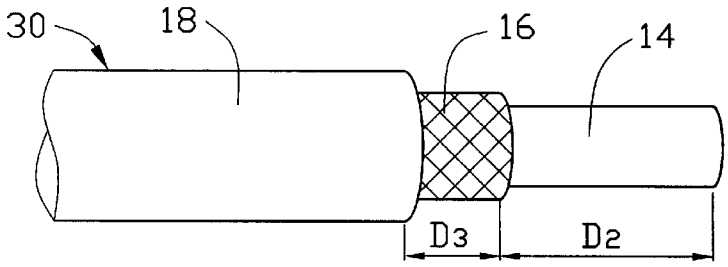
Figure 2C:
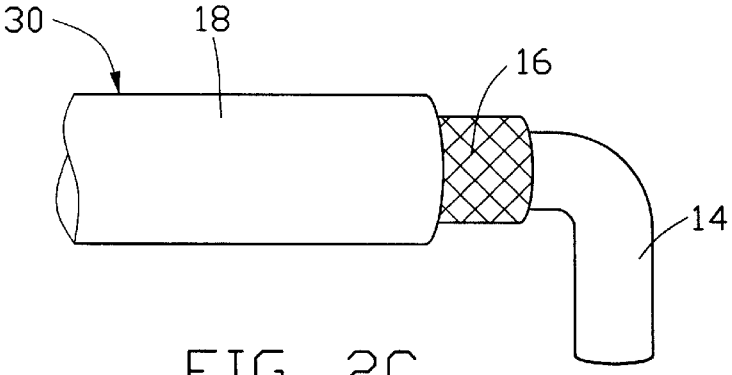
Figure 2D:
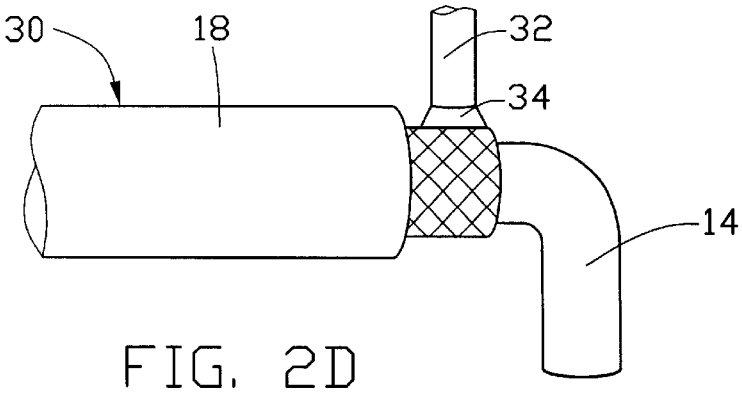

To serve the purpose of receiving/transmitting electromagnetic signals, the braided shield 16 of each antenna cable 30 must be separated from the core conductor 12 a predetermined length measured from the second end thereof. FIGS. 2A–2D show the steps of separating the braided shield 16 from the core conductor 12 in accordance with the present invention. In FIG. 2A, a predetermined first length (D1) of the jacket 18 of each antenna cable 30, measured from the second end thereof, is removed from the cable 30 to expose the braided shield 16. In FIG. 2B, a predetermined second length (D2) of the exposed braided shield 16, measured from the second end thereof, is removed to expose the inner dielectric layer 14. The second length (D2) is less than the first length (D1) whereby a portion (D3) of the exposed braided shield 16 is left on the inner dielectric layer 14 where D3=D1−D2. In FIG. 2C, the core conductor surrounded by the exposed dielectric layer 14 is bent an angle of 90 degrees with respect to the antenna cable 30 whereby this length of the core conductor of the cable 30 is substantially normal to the antenna cable 30. The braided shield that is cut from the antenna cable 30 is twisted to form an elongate consolidated conductor 32 which is then soldered to the portion (D3) of the braided shield 16 left in the antenna cable 30, as indicated at 34, with the consolidated conductor 32 extending in direction substantially normal to the antenna cable 30.

If desired, the consolidated conductor 32 may be replaced by any conductive member. Preferably the replacement conductive member has a length substantially corresponding to the consolidated conductor, namely the second length (D2).

Although the shield is described as a braided shield, shields of other types may also be used, such as a metal foil. In such a case, the metal foil is also subject to being twisted for forming a consolidated conductor to be soldered to the antenna cable 30.

Although the present invention has been described with reference to the preferred embodiment, it is apparent to those skilled in the art that a variety of modifications and changes may be made without departing from the scope of the present invention which is intended to be defined by the appended claims.

What is claimed is:

1. A method for making an antenna of a coaxial cable comprising the following steps:

(a) providing a length of coaxial cable comprising at least a core conductor surrounded by an inner dielectric layer, a conductive shield surrounding the dielectric layer and an outer insulative jacket surrounding the shield;

(b) removing an integral first length of the jacket from the coaxial cable to expose the shield, the first length being measured from an end of the coaxial cable;

(c) removing an integral predetermined second length of the shield measured from the end of the coaxial cable to expose the dielectric layer, the second length being less than the first length whereby a portion of the exposed shield is left on the dielectric layer; and (d) attaching a conductive member to the portion of the exposed shield that is left on the dielectric layer with the conductive member extending in a predetermined angle with respect to the coaxial cable.

2. The method as claimed in claim 1, wherein the conductive member attached to the portion of the shield left on the dielectric layer comprises the removed shield taken out from the cable.

3. The method as claimed in claim 2 further comprising a step of twisting the removed shield to form a consolidated conductive member before the removed shield is attached to the portion left on the dielectric layer.

4. The method as claimed in claim 1, wherein the conductive member is attached to the portion of the shield left on the dielectric layer by soldering.

5. The method as claimed in claim 1, wherein the shield comprises a braided layer of conductive filaments.

6. The method as claimed in claim 5, wherein the conductive filaments are metallic filaments.

7. The method as claimed in claim 1, further comprising a step of bending the exposed dielectric layer and the core conductor surrounded thereby an angle with respect to the coaxial cable.

8. The method as claimed in claim 7, wherein the angle is 90 degrees.

9. The method as claimed in claim 1, wherein the predetermined angle where the conductive member extends with respect to the coaxial cable is 90 degrees.

10. A cable antenna comprising a coaxial cable having a first length of core conductor surrounded by an inner dielectric layer coextensive therewith, a second length of shield layer surrounding the dielectric layer, the second length being less than the first length, an integral end portion of the dielectric layer being exposed, a third length of outer insulative jacket surrounding the shield layer, the third length being less than the second length, an integral end portion of the shield layer being exposed, and a separate elongate conductive member electrically connected to the exposed end portion of the shield layer at a first angle with respect to the coaxial cable.

11. The cable antenna as claimed in claim 10, wherein the exposed dielectric layer and the core conducted surrounded thereby is bent a second angle with respect to the cable.

12. The cable antenna as claimed in claim 11, wherein the second angle is 90 degrees.

13. The cable antenna as claimed in claim 10, wherein the first angle is 90 degrees.

14. The cable antenna as claimed in claim 10, wherein the shield layer is a braided layer of conductive filaments and wherein the elongate conductive member comprises a length of the braided shield layer cut from the coaxial cable and twisted to form a consolidated member.

15. The cable antenna as claimed in claim 10, wherein the elongate conductive member has a length substantially corresponding to the difference between the first and second lengths.

16. The cable antenna as claimed in claim 10, wherein the conductive member is electrically connected to the exposed end portion of the shield layer by soldering.

17. A cable antenna comprising:

a circuit board having a predetermined pattern of conductive traces formed thereon;

a coupling cable having a first end fixed to the circuit board and electrically connected to the conductive traces thereof and a second end forming a connector adapted to be connected to a signal receiving/transmitting circuit;

at least one antenna cable comprising a coaxial cable having a first end fixed to the circuit board and electrically connected to the conductive traces thereof, the coaxial cable comprising a core conductor surrounded by a coextensive inner dielectric layer with a first length thereof, a shield layer surrounding the dielectric layer with a second length, the second length being less than the first length whereby an end portion of the dielectric layer proximate a second end of the coaxial cable is exposed, an outer insulative jacket surrounding the shield layer and having a third length thereof, the third length being less than the second length whereby an end portion of the shield layer proximate the second end of the coaxial cable is exposed, and a separate elongate conductive member electrically connected to the exposed end portion of the shield layer at a first angle with respect to the coaxial cable.

18. A cable antenna comprising a core conductor successively surrounded by an inner dielectric layer, a shield layer and an outer insulative jacket commonly coaxially coextensive therewith, an end portion of the outer jacket, along an axial direction thereof, being removed to expose the internal shield layer, an end portion of the shield layer, along said axial direction and right beside the remaining outer insulative jacket, being removed to radially expose the internal inner dielectric layer, and a conductive member with required stiffness thereof being mechanically and electrically connected to the exposed shield layer wherein said conductive member extends away from said shield layer at a predetermined angle with regard to an axis of the core conductor.

* * * * *